US007779999B2

(12) United States Patent
Piovesan

(10) Patent No.: US 7,779,999 B2
(45) Date of Patent: Aug. 24, 2010

(54) PACKAGING OF COMPONENT STRUCTURES OF SPOOL

(75) Inventor: Joao Domingos Piovesan, Bento Goncalves (BR)

(73) Assignee: Madem S/A Industria E Comercio de Madeiras E Embalagens, Garibaldi (RS) (BR)

( * ) Notice: Subject to any disclaimer, the term of this patent is extended or adjusted under 35 U.S.C. 154(b) by 237 days.

(21) Appl. No.: 11/912,647

(22) PCT Filed: Sep. 25, 2006

(86) PCT No.: PCT/BR2006/000196

§ 371 (c)(1),
(2), (4) Date: Oct. 25, 2007

(87) PCT Pub. No.: WO2007/140553

PCT Pub. Date: Dec. 13, 2007

(65) Prior Publication Data

US 2009/0272837 A1 Nov. 5, 2009

(30) Foreign Application Priority Data

Jun. 6, 2006 (BR) ..... 0602269

(51) Int. Cl.
*B65D 71/00* (2006.01)
*B65H 75/14* (2006.01)

(52) U.S. Cl. ..... 206/226; 242/118.41; 242/160.2; 242/603; 242/613

(58) Field of Classification Search ..... 206/225–226, 206/391, 393, 394, 413–416; 242/118.4, 242/118.41, 160.2–160.4, 578–578.1, 603, 242/609, 609.3, 613
See application file for complete search history.

(56) References Cited

U.S. PATENT DOCUMENTS

| | | | | |
|---|---|---|---|---|
| 1,963,233 | A * | 6/1934 | Goldstein | 206/226 |
| 2,367,214 | A * | 1/1945 | Hedge | 242/118.4 |
| 3,164,252 | A * | 1/1965 | Hosbein | 206/391 |
| 3,605,055 | A * | 9/1971 | Grady | 242/118.41 |
| 3,661,342 | A * | 5/1972 | Sears | 242/118.41 |
| 4,428,546 | A * | 1/1984 | Weideman | 242/578.1 |
| 4,569,491 | A * | 2/1986 | Kauffman | 242/118.41 |
| 5,096,063 | A * | 3/1992 | Schreiter | 206/391 |
| 5,169,086 | A | 12/1992 | Vesely | |
| 5,941,477 | A | 8/1999 | Basili et al. | |
| 6,241,181 | B1 * | 6/2001 | Campbell | 242/609 |
| 2004/0232273 | A1 * | 11/2004 | Arai et al. | 242/603 |

FOREIGN PATENT DOCUMENTS

| | | |
|---|---|---|
| BR | MU6601056 U | 3/1988 |
| BR | PI 9805793-6 A | 11/1999 |
| DE | 2439488 | 2/1975 |

* cited by examiner

*Primary Examiner*—Bryon P Gehman
(74) *Attorney, Agent, or Firm*—Sughrue Mion, PLLC

(57) ABSTRACT

A spool packaging is provided, including a plurality of disks, each having an axial hole therethrough, and arranged in a stack, a plurality of strip supports disposed in the stack such that each pair of adjacent disks is separated by at least four strip supports. The at least four strip supports form a substantially quadrilateral arrangement, and the axial holes of the pair of adjacent disks are disposed at a center of the quadrilateral arrangement. Hardware and closures are disposed between the adjacent disks within the quadrilateral arrangement.

1 Claim, 4 Drawing Sheets

PACKAGING OF COMPONENT STRUCTURES OF SPOOL

FIELD OF INVENTION

The present invention has to do with an improvement in the packaging of component structures of spool for packing energy, telecommunication and steel cables. More specifically, it includes the arrangement of disks, wood for the nucleus, hardware and closures in only one volume, facilitating the storage and the transportation of the dismantled spools.

BACKGROUND OF THE INVENTION

The spool is a frame made up by two wooden disks connected by a nucleus similarly to an axle, with hardware and closures, being that around said spool are coiled cables, wires or rigs (in accordance with ABNT NBR-7483 (Brazilian Association of Technical Norms), the rigs are made up by 2, 3 and 7 wires and cables).

The cables must be packed so as to be protected during transportation, handling and open storage. The spool, therefore, must be sturdy enough to be exempted from defects that might damage the product.

Generally, the spools are provided dismantled, where the component parts—disks, nucleus, hardware and closures are arranged in individual packages, being up to the user to assemble the product, which generates a lot of movement and the need of a large enough physical area.

The request for the patent of invention PI9805793-6 describes a dismountable and reusable modular spool for transmission cables and the process of manufacture of the same, which has at least two compartments arranged side by side for the transmission line of spooling, and which includes a couple of flanges of parallel ends spaced between them, generally circular, at least one intermediary dividing ring, generally circular, a support nucleus for the cable positioned between each flange of the ends and dividing ring adjacent and between each couple of adjacent dividing rings, a plurality of binding beams that are extended between the couple of flanges of ends that extend through the cable support nuclei and that extend through the dividing rings and means of unfastening fixation secured to the binding beams to pressure the ended flanges, the dividing rings and the support nuclei one in the direction of the other in an array mounted so that when the means of fixation are unfastened, the ended flanges, the dividing rings, the support nuclei and the binding beams are promptly separated for the transportation in a dismountable way for reassembly and reutilization.

The request for the utility model MU6601056-0 describes a wooden spool for electric cables with braces for wedges as of a structure formed by two wooden disks conveniently separated by a nucleus and fixed by an ideal number of wooden braces, being at least three and in accordance with the diameter of the wooden disks; said wooden braces with cuts or fissures in amounts necessary at their ends and the use of wooden wedges by trans-crossing of the ends of the wooden braces through the wooden disks and their respective wedges, consequently pulled subject to the compression of the wooden disks against the braces also made of wood providing rigidity to the set.

The document DE2439488 shows a reel which can be dismantled into the flanges and separable strut assemblies to built the core. These separable parts are made of plastic and are preformed in a bent manner to build a circular shaped cross section in the assembled core. Therefore those parts are not flat and cannot be arranged for optimal packaging.

The document U.S. Pat. No. 5,169,086 presents a collapsible reel with collapsible strut assemblies affixed to the flanges and split at their mid-portion. In case of transportation the strut assemblies fold radially outward. Since the strut parts are not shaped in a flat manner also this device cannot be collapsed in na optimal flat shape.

The document U.S. Pat. No. 5,941,477 shows reel components with cooperative locking members containing one flange integrated with a half length core to be stacked in a compact manner. This assembly is completely constructed of plastics so that different parts fit precisely together for stacking.

Therefore, the technical literature presents unique packages for each component of a spool, not being suggested nor described a single package that gathers the disks, hardware and closures and lathes of the nucleus, facilitating transportation and storage, such an improvement in packaging being described and claimed by means of the present request.

SUMMARY

In a general way, the present invention refers to an improvement in the packaging of component structures of spool that includes the arrangement of strip supports intercalated by disks, said strip supports arranged in a quadrilateral on the surface of the disk, having the hole passing from the disk placed in the central region of the quadrilateral formed by the strip supports and in the inner area of the quadrilateral formed by the strip supports being arranged the hardware and closures.

It is a characteristic of the invention a packaging that aggregates in only one set the disks, hardware and closures and strip supports for shaping of the nucleus, facilitating transportation and storage.

DETAILED DESCRIPTION OF THE INVENTION

Figure 1:
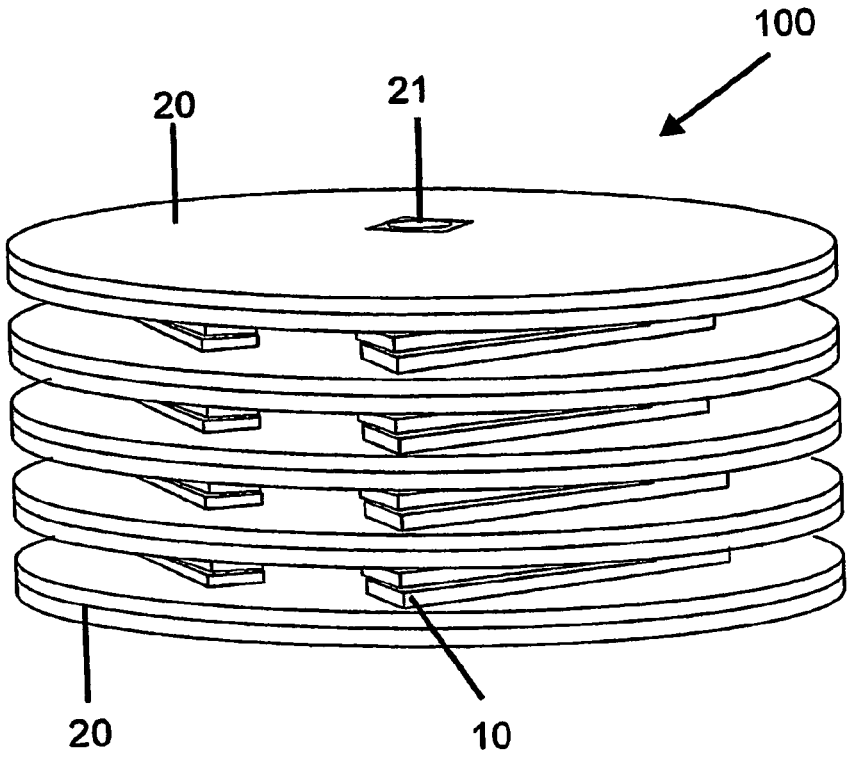
FIG. 1 has the view under the perspective of the dismantled spool with the component parts grouped in only one set.
Figure 2:
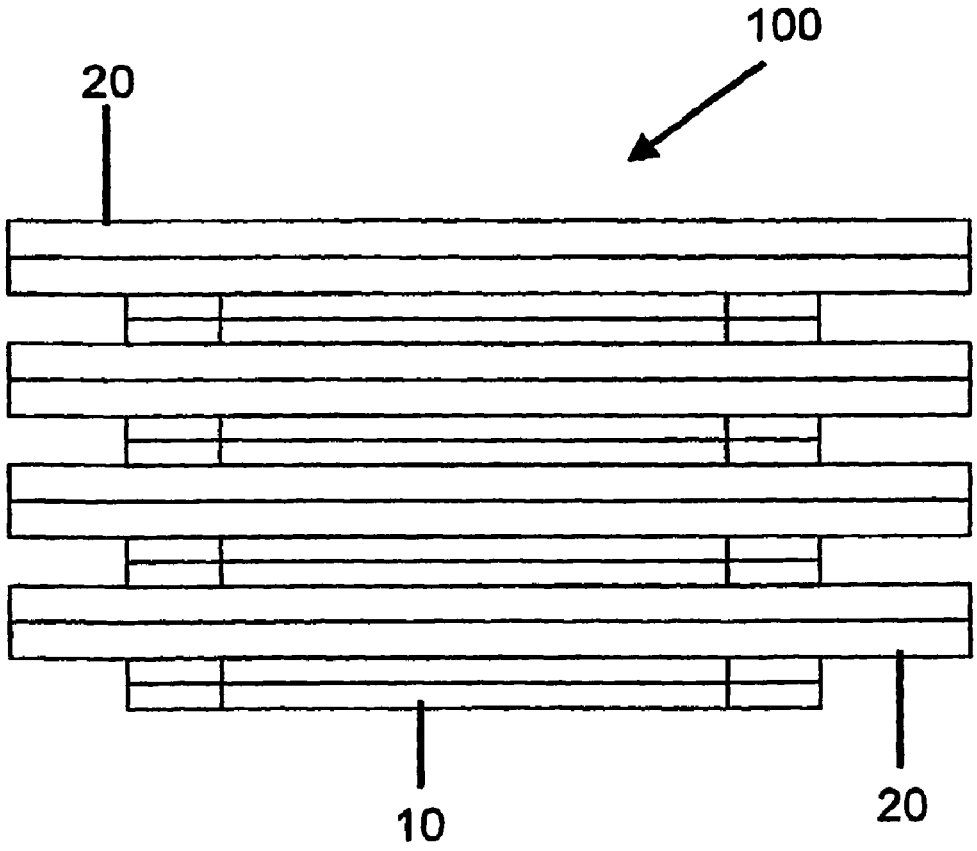
FIG. 2 presents the frontal view.
Figure 3:
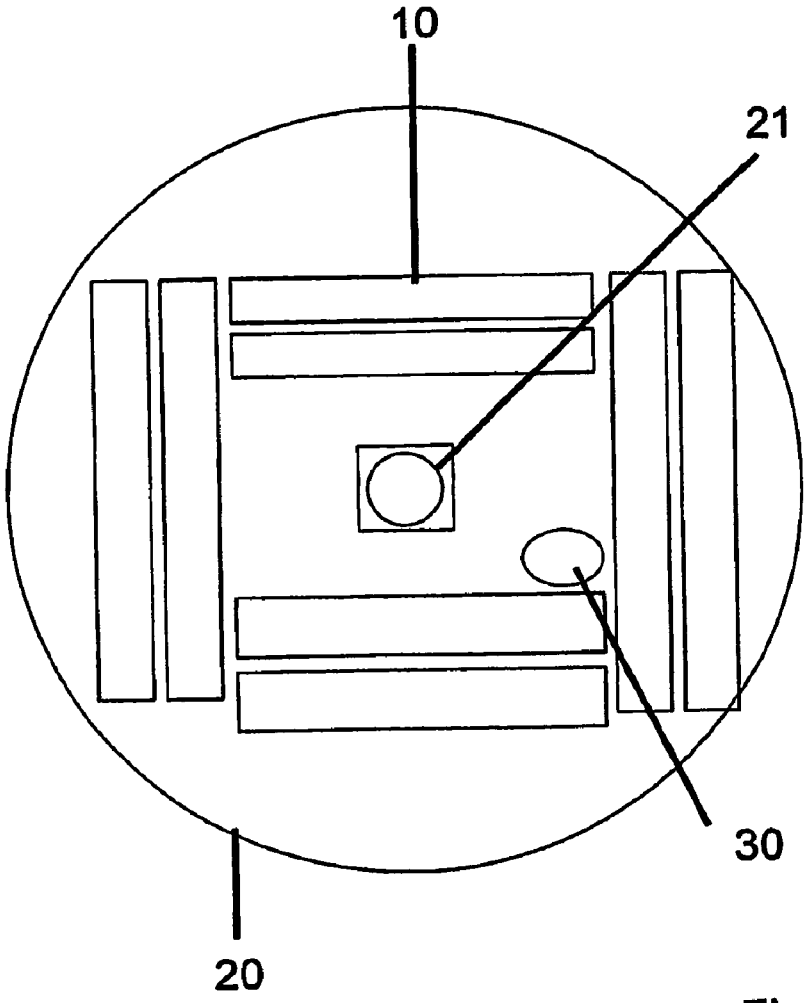
FIG. 3 presents a representation of the arrangement of the wood making up the nucleus of the spool and the hardware.
Figure 4:
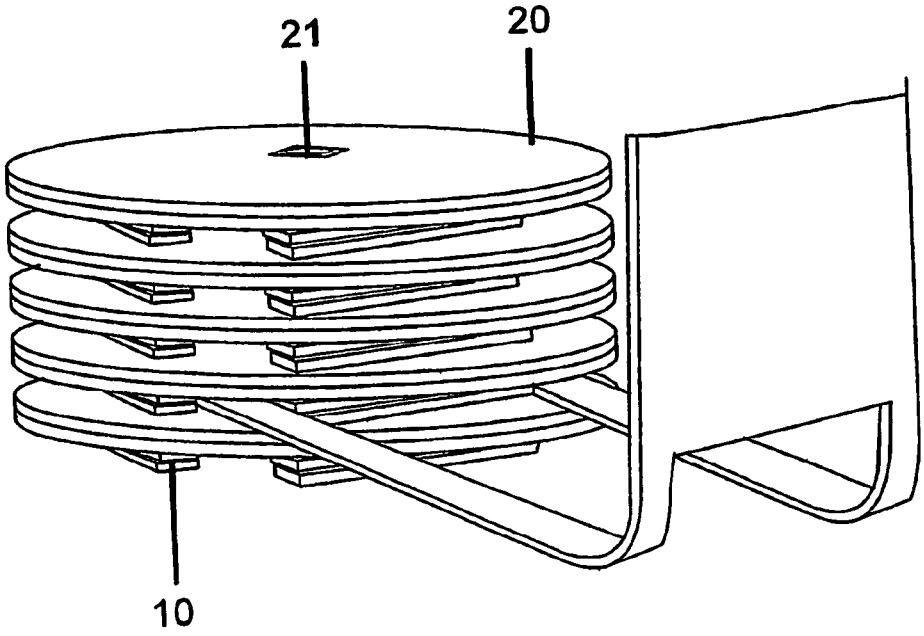
FIG. 4 presents a representation of the only set of component parts of the spool in a transport situation.

The constructive arrangement in spool for the packaging of cables, object of the present invention, includes the arrangement of the component parts of a spool (100) in only one set, so as to facilitate the storage and assembly operations.

The constructive arrangement in spool (100) includes the arrangement of strip supports (10) intercalated by disks (20), said strip supports (10) arranged in quadrilateral on the surface of the disk (20), having the hole crossing (21) from the disk (20) placed in the central region of the quadrilateral formed by the strip supports (10).

In the inner area of the quadrilateral formed by the strip supports (10) the hardware and closures (30) are arranged.

For the assembly of the spool (100), having in view its dimension, the inclusion in only one set of all the components facilitates the movement in the location of assembly, reduces the storage space and facilitates the transportation operation by arranging the disks (20) spaced by strip supports (10), configuring a niche appropriate for the movement by fork-lifts.

The invention claimed is:

1. A spool packaging, comprising:

a plurality of discrete strip supports;

a plurality of disks disposed in a stack, each disk having an axial hole therethrough;

wherein the plurality of discrete strip supports are disposed within the stack such that each pair of adjacent disks is separated by a group of four said strip supports, each said group of four strip supports forms a substantially quadrilateral arrangement, wherein the axial holes of any pair of adjacent disks are disposed at a center of the corresponding quadrilateral arrangement; and the spool packaging further comprising hardware and closures disposed between adjacent disks within the corresponding quadrilateral arrangement.

* * * * *